United States Patent [19]

Dassler et al.

[11] Patent Number: 4,633,600

[45] Date of Patent: Jan. 6, 1987

[54] OUTER SOLE FOR AN ATHLETIC SHOE HAVING CLEATS WITH EXCHANGEABLE SNAP-ON GRIPPING ELEMENTS

[75] Inventors: Armin A. Dassler; Willi Bauer, both of Herzogenaurach, Fed. Rep. of Germany

[73] Assignee: Puma AG Rudolf Dassler Sport, Fed. Rep. of Germany

[21] Appl. No.: 830,861

[22] Filed: Feb. 19, 1986

[30] Foreign Application Priority Data

Feb. 19, 1985 [DE] Fed. Rep. of Germany ..... 3505665

[51] Int. Cl.[4] ..... A43C 15/02; A43C 15/16

[52] U.S. Cl. ..... 36/134; 36/59 R; 36/67 D; 36/67 R

[58] Field of Search ..... 36/134, 67 R, 67 D, 36/62, 64, 67 A, 61, 59 R; 24/621, 622; 411/120, 123; 403/407.1

[56] References Cited

U.S. PATENT DOCUMENTS

| | | | |
|---|---|---|---|
| 2,607,134 | 8/1952 | Langer | 36/67 D |
| 2,607,135 | 8/1952 | Langer | 36/67 D |
| 3,054,197 | 9/1962 | Morgan et al. | 36/59 R |
| 3,267,593 | 8/1966 | Turner | 36/67 D |
| 3,731,406 | 5/1973 | Young | 36/67 D |
| 3,911,600 | 10/1975 | Dassler | 36/67 D |
| 4,414,763 | 11/1983 | Bente | 36/134 |
| 4,445,288 | 5/1984 | Fror | 36/67 D |
| 4,445,289 | 5/1984 | Beneteau | 36/67 D |
| 4,470,207 | 9/1984 | Bente | 36/61 |
| 4,492,047 | 1/1985 | Arff | 36/134 |

FOREIGN PATENT DOCUMENTS

| | | | |
|---|---|---|---|
| 1888123 | 12/1963 | Fed. Rep. of Germany . | |
| 2543268 | 3/1977 | Fed. Rep. of Germany | 36/67 D |
| 3003361 | 8/1981 | Fed. Rep. of Germany | 36/134 |
| 2409023 | 7/1979 | France | 36/67 R |

*Primary Examiner*—Werner H. Schroeder
*Assistant Examiner*—Steven N. Meyers
*Attorney, Agent, or Firm*—Sixbey, Friedman & Leedom

[57] ABSTRACT

Athletic shoe sole with cleats having exchangeble grip elements that are snap-locked to a mounting stud. The grip element can easily be inserted and removed again, without impairment of shoe sole stability or danger of damage thereto, by the provision of interactive engagement formations, comprised of a minimum of one raised area 16, 17, 26 and a complementary recessed area 19, 28, that have at least one inclined surface that produces a relative axial shifting between the gripping element and mounting stud when the gripping element is rotated about its longitudinal axis. Preferably, the raised areas 16, 17, 26 are arranged such that, in the snap-locked condition, they do not have operative contact with the recessed areas 19, 28, but can be brought into operative contact by rotating grip element 11 around its longitudinal axis x, and thereafter the grip element 11 can be pressed out over the catch point of the snap-lock device or snap-lock devices 8, 12 to release the grip element from the mounting stud.

20 Claims, 6 Drawing Figures

FIG.1
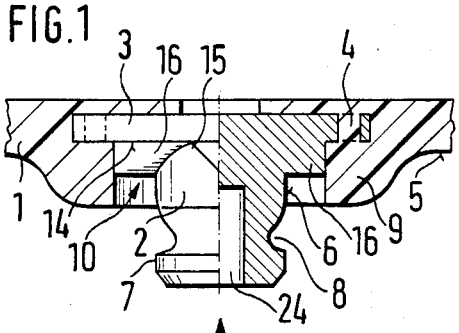
FIG.3
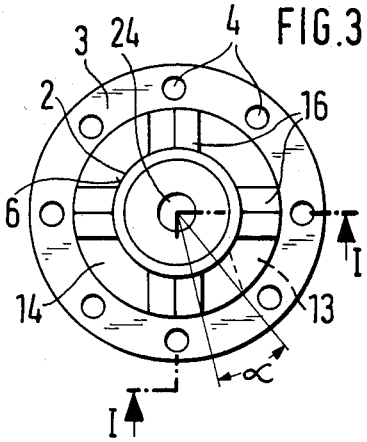
FIG.2
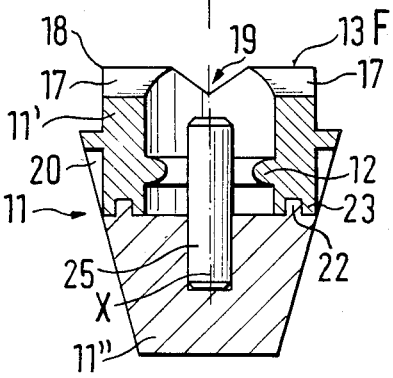
FIG.5
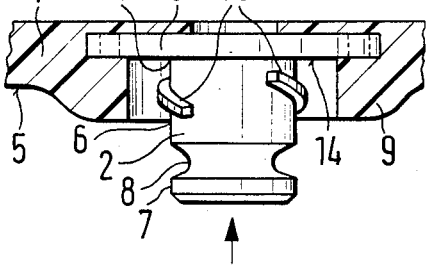
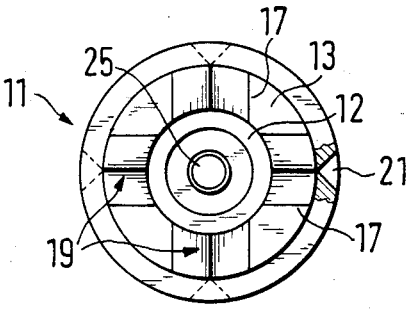
FIG.4
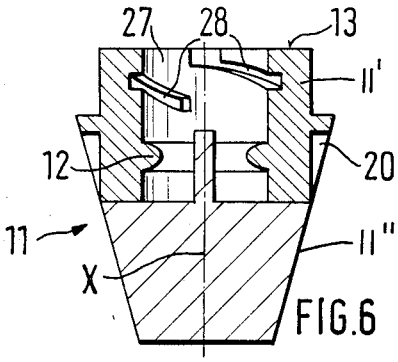
FIG.6

OUTER SOLE FOR AN ATHLETIC SHOE HAVING CLEATS WITH EXCHANGEABLE SNAP-ON GRIPPING ELEMENTS

BACKGROUND AND SUMMARY OF THE INVENTION

The present invention relates to an outer sole for an athletic shoe of the type having cleats with exchangeable gripping elements that are secured to mounting studs by at least a snap-lock arrangement.

Outer soles for athletic shoes of the initially mentioned type are described in German Utility Model Pat. No. 18 88 123 and U.S. Pat. No. 3,054,197, as well as our co-pending U.S. application Ser. No. 756,249, filed July 18, 1985. In the arrangement of German Utility Model Pat. No. 18 88 123, a mounting stud for a gripping element of a cleat is securely attached to the sole and exchangeable cap-like gripping elements are mountable onto these stubs whereon they are held by barb-like projections which are received in associated notches in the outer surface of the cleat holding element and/or by axial mounting pins. For removal of the cap-like gripping elements, a suitable tool is utilized.

Similarly, in U.S. Pat. No. 3,054,197, an athletic shoe with a snap-on shoe cleat assembly is disclosed wherein a mounting stud is threadingly secured into the sole, at one end, while the opposite end is enlarged to enable a cap-like cleat body element to be snapped thereon and held in place. For removal of the cleat body element from the mounting stud, a tool having a slotted, turned-up end is inserted between the bottom end of the cap-like cleat body element and the bottom surface of the sole to enable the cleat body element to be pried off the stud.

In our above-noted, co-pending U.S. application Ser. No. 756,249, gripping elements that are in the form of caps are secured on stud-shaped holding elements by a snap-lock arrangement of raised and recess areas formed coaxially about the stud-shaped holding elements and within the cap-shaped gripping elements. By a disclosed angling of the walls of the recessed areas, the ease of removal of the gripping elements caps is improved. In this regard, the periphery of the gripping element cap is provided with prism-like recesses or the like into which a removable tool can be engaged. For purposes of prying off the gripping elements from the mounting studs.

In addition to snap-on exchangeable gripping elements, cleats are known (see, e.g., our co-pending U.S. patent application Ser. No. 756,250, filed July 18, 1985) wherein a threaded fastening of the gripping elements to the mounting studs is utilized instead of a snap-lock arrangement. While the use of a threaded arrangement instead of a snap-lock arrangement, for securing an exchangeable gripping element onto a mounting stud of athletic shoe sole cleats, provides an easier means for removing of the gripping elements from their respective mounting studs than is the case with respect to known snap-lock arrangements, unlike snap-locks, threaded mounting arrangements require some auxiliary locking arrangement, such as a ratchet mechanism, to effectively ensure that the gripping elements will not loosen from the mounting studs during use.

Thus, it is a primary object of the present invention to provide an athletic shoe sole of the initially-mentioned type that is designed so as to facilitate easy insertion and removal of the gripping elements from their snap-on mounting studs without diminishing the stability of the sole or causing damage thereto.

This object is achieved, in accordance with preferred embodiments of the present invention, by providing a means which, by rotation of the gripping element, or a portion thereof, about its longitudinal axis, will axially shift the gripping element relative to its respective mounting stud to an extent sufficient to disconnect the snap-lock interconnection between the mounting stud and gripping element. In accordance with one form of the invention, the means for producing longitudinal shifting of the gripping element relative to its mounting stud is in the form of at least one raised area projecting from a base area of the mounting stud that has an inclined ramp-like surface which coacts with a complementary surface formed at the base end of the gripping element. In accordance with another form of the invention, this means is formed by the provision of at least a partial thread on the periphery of the mounting stud that coacts with a like threading on the interior of the gripping element.

The gripping elements or at least a part thereof, advantageously, are softer or more resilient than the material of either of the stud and/or of the sole itself, so as to provide easy snap-on engagement and removal of the gripping elements without damage to the shoe sole. For example, when projections are provided in the manner of an inclined plane, lift-off pressure is produced when the gripping elements are rotated and the gripping element is able to be pressed outwardly relative to the mounting studs so that it can pass the catch point of the snap-lock arrangement, i.e., the point beyond which the snap-lock will no longer resecure itself if gripping element is released. In this manner, no damage is caused to the shoe sole during the removal of the gripping elements. Furthermore, removal of the gripping elements as well as retipping of the cleats can be accomplished in a very short time.

These and further objects, features and advantages of the present invention will become more obvious from the following description when taken in connection with the accompanying drawings which show, for purposes of illustration only, several embodiments in accordance with the present invention.

BRIEF DESCRIPTION OF THE DRAWINGS

FIG. 1 is a side cross-sectional view of a shoe sole in accordance with the present invention taken through a mounting stud along line A-B of FIG. 3.

FIG. 2 is a side cross-sectional view of a gripping element for use with the mounting stud of FIG. 1.

FIG. 3 is a bottom view of the mounting stud of the shoe sole.

FIG. 4 is a base end view of the gripping element of FIG. 2.

FIG. 5 is a sectional view of a modified stud embodiment.

FIG. 6 is a sectional side view of a gripping element for use with the stud depicted in FIG. 5.

DETAILED DESCRIPTION OF THE PREFERRED EMBODIMENTS

In FIG. 1, numeral 1 designates a portion of a shoe sole, particularly the outer sole of an athletic shoe, e.g., football shoe, hockey shoe, soccer shoe or baseball shoe. Generally, this outsole consists primarily of one piece, made of injection molded or cast synthetic material, like polyurethane, polyethylene, polyamide, hexamethylene diamine adipic acid polycondensate or the like, and extends over the entire sole, including the heel. However, the heel and the actual sole portion may consist of two separate parts, in which case, the studs of the invention, described below, are provided for each part. The studs are distributed in a conventional manner. Such distribution, for example, would be determined by considerations of the sole's stress profile and/or the required skid resistance of the athletic shoe on the playing field.

Stud 2 is firmly molded or cast into outer sole 1 by way of an integral flange 3. Flange 3, preferably, has cutouts 4, for example, in the form of perforations, through which the sole material may flow, so as to ensure good anchorage of flange 3 within the sole material. Basically, studs 2, however, may consist of the material of outer sole 1, and thus be integrated therewith, i.e, they may be molded portions of the sole itself.

Stud 2 projects outwardly beyond the outer surface 5 of sole 1, and may be of a cylindrical configuration or a truncated conical configuration having the broader base at shoe sole 1.

Outer surface 6 of stud 2 has a snap-lock member in the form of annular groove 8 near its free end portion. Shoe sole 1, or a portion of the sole separately applied thereto, forms a toric ridge 9 surrounding stud 2 at a predetermined distance, thereby forming a circular free space 10 between outer surface 6 of stud 2 and the inner wall of ridge 9.

Gripping element 11 can be slipped onto stud 2, and can be inserted into free space 10 with as little play as possible. The snap-lock member of gripping element 11 is comprised by annular rib 12 which engages annular groove 8, thereby fastening gripping element 11 onto stud 2. Advantageously, base portion 13 of gripping element 11 frictionally contacts an exposed base portion 14 of flange 3, which surrounds the foot 15 of stud 2. Basically, two or more annular ribs 12 and/or annular grooves 8, respectively, may be provided on the gripping element 11 and stud 2, respectively, e.g., as is the case for the cleats of our co-pending application Ser. No. 756,249.

Raised areas 16, in the form of radially extending roof gable shaped ribs, are provided at base portion 14 of flange 3 to facilitate easy removal of gripping element 11 from stud 2. Similarly, at the inner end portion of gripping element 11, notched areas 17 are formed in the base portion 13 that provide roof gable shaped grooves 19 extending radially inwardly from the peripheral base edge 18 of gripping element 11, which grooves correspond to the raised areas 16 at base portion 14 of flange 3. In each case, a minimum of one raised area 16, and notched area 17, respectively, is provided at the base portion 14 and gripping element base portion 13, at least one side of which has an inclined plane configuration.

The roof gable shape of raised area 16 or grooves 19, respectively, results in a sloping design of both sides. To facilitate assembly, their configuration to each other is such that when snap-locked, they do not or only slightly, touch. Both inclined planes slide along each other only when an installed gripping element 11 is rotated around its longitudinal axis x (FIG. 2), and whereupon a wall of notched area 17 slides on an inclined plane of the corresponding raised element 16, the presence of two opposite inclines enabling the same result to be achieved in either rotational direction. The sliding of the notch wall on the inclined side of raised area 16 produces a force, in the direction of axis x, that pushes gripping element 11 away from shoe sole 1. The height of areas 16, 17 is dimensioned so that an axial displacement of gripping element 11 is produced that is sufficient to release the snap-lock connection between stud 2 and gripping element 11, i.e., annular rib 12 snaps out of annular groove 8.

An advantageous embodiment of this arrangement provides a configuration of raised areas 16, 17, such that gripping element 11 can be rotated through an angle alpha (FIG. 3), without raised areas 16, 17 having operative engagement. In the example according to FIG. 3, this is realized by a design in which base parts 13 of grip element 11 are smaller than base portion 14 of flange 3. In FIG. 3, the relative size of such a base part 13 has been indicated by dotted lines on a corresponding base portion 14; this relationship can also be seen by a comparison of FIGS. 3 and 4. A prerequisite here is that groove 19 is deeper than the height of raised area 16 and greater in width or is given a truncated shape of corresponding height but greater width.

In order to facilitate an easy rotation of grip element 11, key inset areas 20 are formed into its peripheral wall. Preferably, these key inset areas are acutely angled notches 21 (FIG. 4). Alternatively, the peripheral wall may also be of square, hexagon or similar cross-sectional shape so that a conventional open-end wrench may be used, thereby eliminating the need for special tools. In this regard, it is noted that a suitable tool for the illustrated embodiments may be in the form of a skate-type key of a general T-shape, the base leg of which has a socket formed in its bottom end and this socket being of a shape designed to mate with the peripheral wall grip element 11, including key inset areas 20. As an aide to aligning areas 16 and 17, small recesses, ridges or other matching indicia may be provided on the key and ridge 9 at appropriate locations.

Advantageously, grip element 11 may consist of two parts, i.e., a grip element body part 11', which is a snap-lock member, and a cleat tread part 11'', constituting the actual gripping component. These parts are firmly connected, i.e., either glued or welded. To facilitate better anchoring of parts 11' and 11'' a plurality of pegs 22 can be provided which project from tread part 11'' into engagement with corresponding bores 23 of grip element body part 11'. The cleat tread parts 11'' are comprised of a material adapted to the conditions of the terrain, in the usual manner.

Stud 2 is made of relatively hard or very hard material, which should, if possible, also be resistant to bending. Therefore, when using studs 2 which are molded to the shoe sole or at least the outsole 1 (when the shoe sole consists of differing materials) is made of such hard materials, as for instance, hard PVC, hard polyurethane, polyethylene, polyamide, polyimide, polycarbonate or similar materials. When studs 2 are to be inserted, snap-locked, or molded into the sole as individual components, the studs are made of the same synthetic materials mentioned, but the sole may consist of a softer material.

Studs 2 as individual components may also consist of a metal, such as aluminum, copper, brass, bronze, steel, die cast zinc or the like, or can be made of ceramic materials, as for instance, aluminum oxide, zirconium oxide, steatite, silicon carbide or the like, or can be made of mixtures of the above combined with other ceramic compounds like $SiO_2$, CaO, MgO, etc.

In order to improve fastening of grip element 11 onto stud 2, a pin 25 is provided on the grip element 11, or its cleat tread element 11'', for engaging a central bore 24 of stud 2. This pin can be a molded part of grip element 11 or its tread element 11' (FIG. 6) or can be fastened to it (FIG. 2) in any suitable manner. Furthermore, when pin 25 is not a molded part of the grip element, it preferably consists of an elastic or metallic material which is tougher than the grip element material.

According to a further embodiment of the invention depicted in FIGS. 5 and 6, the means for axially shifting the grip elements 11 along the outer surface 6 of stud 2, so as to disengage the snap-lock, may be in the form of thread sections 26 of a multiple thread. In such a case, interior wall 27 of grip element 11 or grip element portion 11'' is provided with corresponding counter thread sections 28, which, for example, may be in the form of corresponding grooves which are open at base 13 and can be widened relative to section 26 to afford the same angular movement alpha as achieved in the first mentioned embodiment.

While we have shown and described various embodiments in accordance with the present invention, it is understood that the same is not limited thereto, but is susceptible of numerous changes and modifications as known to those skilled in the art, and we, therefore, do not wish to be limited to the details shown and described herein, but intend to cover all such changes and modifications as are encompassed by the scope of the appended claims.

We claim:

1. Athletic shoe sole having cleats with exchangeable grip elements of the type including mounting studs attached to the sole and a grip element, at least a part of which is made of elastic material that is securable over a respective mounting stud by way of a snap-lock arrangement comprised of at least one exterior surface formation of each stud that is interengageable with a complementary grip element inner wall surface formation, wherein the sole is provided with disengagement means, that is operative by rotation of at least part of the grip element about its longitudinal axis, for producing a longitudinal displacement of the grip element relative to its respective mounting stud sufficient to shift the surface formations past a catch point thereof so as to release said snap lock arrangement securing the grip element of the cleat from the mounting stud thereof.

2. Athletic shoe sole according to claim 1, wherein a peripheral base edge of each grip element is surrounded by a torus.

3. Athletic shoe sole according to claim 2, wherein the torus 9 is a molded portion of the sole.

4. Athletic shoe sole according to claim 1, wherein said disengagement means comprises at least one pair of raised and recessed areas having at least one ramp-like surface, one of said raised and recessed areas being disposed in an area of the base of a mounting stud and the other thereof at a base of the grip element.

5. Athletic shoe sole according to claim 4, wherein the raised area of said disengagement means is provided at the base of the mounting stud and the recessed area thereof is provided at the base of the grip element.

6. Athletic shoe sole according to claim 5, wherein the raised and recessed areas are essentially out of operative engagement in a snap-locked usage condition of the sole.

7. Athletic shoe sole according to claim 6, wherein the raised and recessed areas are arranged and disposed such that grip element can be rotated through an angle about its longitudinal axis when it is in the snap-locked condition without causing operative engagement between the raised and recessed areas.

8. Athletic shoe sole according to claim 4, wherein the raised and recessed areas are arranged and disposed such that grip element can be rotated through an angle about its longitudinal axis when it is in a snap-locked condition without causing operative engagement between the raised and recessed areas.

9. Athletic shoe sole according to claim 8, wherein the raised areas are radial ribs, and the recessed areas are radial grooves coordinated thereto.

10. Athletic shoe sole according to claim 9, wherein the ribs and grooves are of roof gable shape.

11. Athletic shoe sole according to claim 4, wherein each grip element is provided with key insert areas for use in producing rotation of the grip element by a tool.

12. Athletic shoe sole according to claim 4, wherein the raised areas are radial ribs, and the recessed areas are radial grooves coordinated thereto.

13. Athletic shoe sole according to claim 12, wherein the ribs and grooves are of roof gable shape.

14. Athletic shoe sole according to claim 1, wherein a central bore is provided in each mounting stud into which a pin carried by the grip element is engaged.

15. Athletic shoe sole according to claim 14, wherein the pin is inserted into the grip element.

16. Athletic shoe sole according to claim 14, wherein the pin is molded to the grip element.

17. Athletic shoe sole according to claim 14, wherein the pin consists of a harder material than the elastic material of the grip element.

18. Athletic shoe sole according to claim 1, wherein the grip element is comprised of a body part, formed of said elastic material and having said inner wall surface formation therein, and of a cap-like tread part covering an outer end portion of said body, said tread part being formed of a material suited to the surface conditions upon which the sole is intended for use.

19. Athletic shoe sole according to claim 1, wherein the disengagement means comprises at least one pair of inclined raised and recessed formations, one of said formations being provided on the inner wall of the grip element and the other on said exterior surface of the stud.

20. Athletic shoe sole according to claim 19, wherein said formations are thread parts.

* * * * *